US005430615A

United States Patent [19]

Keeth et al.

[11] Patent Number: 5,430,615

[45] Date of Patent: Jul. 4, 1995

[54] PRINTED CIRCUIT BOARD ASSEMBLY

[75] Inventors: Brent Keeth, Penn Valley; Michael Deering, Oroville; Ray Bryars, Nevada City; Charles VanDusen, Cedar Ridge, all of Calif.

[73] Assignee: The Grass Valley Group, Inc., Nevada City, Calif.

[21] Appl. No.: 203,738

[22] Filed: Feb. 28, 1994

Related U.S. Application Data

[63] Continuation of Ser. No. 55,393, May 3, 1993, abandoned, which is a continuation of Ser. No. 902,569, Jun. 22, 1992, abandoned, which is a continuation of Ser. No. 567,494, Aug. 14, 1990, abandoned.

[51] Int. Cl.[6] ..... H01R 23/68; H01R 9/09

[52] U.S. Cl. ..... 361/788; 361/789; 361/785; 361/790; 361/791; 361/796; 361/799; 361/803; 439/61; 439/62; 439/65

[58] Field of Search ..... 211/41; 361/788, 796, 361/797, 799, 800, 803, 804; 439/61, 62, 65, 74, 75, 377

[56] References Cited

U.S. PATENT DOCUMENTS

| | | | |
|---|---|---|---|
| 3,829,741 | 8/1974 | Athey | 361/412 |
| 4,179,172 | 12/1979 | Godsey et al. | 361/413 |
| 4,179,724 | 12/1979 | Bonhomme | 361/391 |
| 4,251,853 | 2/1981 | Sites | 361/415 |
| 4,288,838 | 9/1981 | Van Der Vegte et al. | 361/415 |
| 4,511,950 | 4/1985 | Bunner et al. | 361/412 |
| 4,573,753 | 3/1986 | Vogl | 439/92 |
| 4,631,641 | 12/1986 | Brombal et al. | 361/424 |
| 4,703,394 | 10/1987 | Petit et al. | 361/413 |
| 4,821,145 | 4/1989 | Corfits et al. | 361/424 |
| 4,893,405 | 1/1990 | Pennington | 361/415 |
| 4,900,948 | 2/1990 | Hamilton | 361/412 |
| 4,949,171 | 8/1990 | Grandmougin | 361/416 |
| 5,030,108 | 7/1991 | Babow et al. | 361/415 |

FOREIGN PATENT DOCUMENTS

| | | | |
|---|---|---|---|
| 2-309581 | 12/1990 | Japan | 228/180.1 |

OTHER PUBLICATIONS

AT&T Technical Digest "Circuit Pack Adaptor For High-Speed Circuit Packs" by Eminger No. 73 1/84.

IBM Technical Disclosure Bulletin "Field Replaceable Engineering Change Package" by J. Kresge vol. 18 No. 12 5/76.

IBM Technical Disclosure Bulletin "Interposers For Power and Signal Transmission" by Aug et al. vol. 20 No. 10 3/78.

*Primary Examiner*—Leo P. Picard
*Assistant Examiner*—Donald A. Sparks
*Attorney, Agent, or Firm*—John Smith-Hill; Francis I. Gray

[57] ABSTRACT

Electronic apparatus comprises a main circuit board, a transition board, and a first connector composed of a first part attached to the main circuit board at one edge thereof and a second part attached to the transition board at a first main face thereof, whereby when the first and second parts are engaged the transition board is substantially perpendicular to the main circuit board. The transition board is attached to a connector board so that the second main face of the transition board is in spaced substantially parallel confronting relationship with a first main face of the connect or board. A second connector is composed of a first part attached to the connector board at its first main face and a second part attached to the transition board at its second main face.

17 Claims, 7 Drawing Sheets

PRINTED CIRCUIT BOARD ASSEMBLY

This is a continuation of application Ser. No. 08/055,393 filed May 3, 1993 and now abandoned; which is a continuation of application Ser. No. 07/902,569 filed Jun. 22, 1992 and now abandoned; which is a continuation of application Ser. No. 07/567,494 filed Aug. 14, 1990 and now abandoned.

BACKGROUND OF THE INVENTION

This invention relates to a printed circuit board assembly.

A standard has developed whereby many electronic products are mounted in racks composed of vertical posts that are at a uniform horizontal spacing of around 48 cm. The electronic product is installed in a casing or frame that is slightly narrower than the horizontal space between the vertical posts, and the frame is inserted into the rack and secured by attachment ears to the two posts. Further, a standard has developed such that the frames are of a uniform height of about 13.2 cm.

Many electronic products are sufficiently small that they do not occupy an entire frame of standard height and width. In such a case the interior space of the frame may be divided into compartments and multiple products, which may or may not be functionally similar, are installed in the compartments respectively. This modular product approach not only avoids waste of space in the frame but also allows the user to select for installation in a given frame the particular modules that meet his requirements.

In one implementation of the modular product concept, each module comprises two main components, namely a backplane assembly that is attached to the frame at the rear, and a main circuit board assembly that is inserted into the appropriate compartment from the front of the frame. The backplane assembly comprises a connector board provided with connectors for connection to signal input and output (I/O) cables and the main circuit board assembly comprises a front panel which constitutes the user interface and is provided with, for example, indicator lamps and controls, and a main circuit board which extends into the compartment from the front panel. The leading edge of the main circuit board assembly carries one part of an edge connector, a complementary part of which is attached to the backplane assembly and is engaged when the main circuit board assembly is properly installed in its compartment. It may be necessary for the edge connector that connects the backplane assembly to the main circuit board assembly to have 32 or more pins.

The modular product concept has found acceptance in video signal processing applications.

Video signal processing is a connection-intensive field, and it might be desirable for the backplane assembly of a single module whose connector board is about 3 cm wide to carry twelve or more I/O connectors. These connectors may be BNC connectors. A BNC connector is a coaxial connector that is substantially cylindrical and about 0.95 cm in diameter, and generally occupies an area of the connector board that is about 1 cm square. The centers of BNC connectors must be spaced by at least 1.6 cm in order to avoid difficulty in connecting and disconnecting cables from the connectors. If the BNC connectors are arranged in two rows and the centers of the rows are 1.6 cm apart, the horizontal width of the strip-form region between the areas occupied by the two rows is only about 0.5 cm. This implies that any connector that is mounted on the connector circuit board between the rows of BNC connectors must be narrower than 0.5 cm.

One type of connector that is used to interconnect circuit boards is known as the DIN connector. The male portion, or header, of a DIN connector comprises a housing of insulating material formed with three rows of holes. The holes in a row are about 0.25 cm apart, and the rows are about 0.17 cm apart. Metal pins are fitted in the holes. The housing of the connector is about 1 cm wide. In one version, the housing is about 9.2 cm long and is provided with 96 pins in three rows of 32 pins each. Although this type of connector has more than enough pins for connecting to the main circuit board of many modular products, it cannot be accommodated on the connector circuit board because the housing is too wide to fit between the two rows of BNC connectors spaced at less than about 2 cm.

Another type of connector that is in use is known as the single in-line, or SIP, connector. The header of a SIP connector is about 0.3 cm wide and the space between pins is the same as the DIN connector. The SIP connector is not designed for frequent connections and disconnections.

An attempt has been made to accommodate a standard DIN connector in the backplane assembly of a modular product by including an interface board in the backplane assembly. The interface board is attached to the connector board by a row of attachment pins that project from the connector board at right angles between the two rows of BNC connectors and pass through respective holes in the interface board. The pins are bent over through 90 degrees so that the interface board extends perpendicular to the connector board. The attachment pins also provide electrical connection between circuit traces of the connector board and circuit traces of the interface board. The interface board is provided with one portion of the DIN connector along its edge farther from the connector board. The circuit traces of the interface board provide connections between the attachment pins and the pins of the DIN connector. A power supply is fitted in one compartment of the frame, and power is supplied to the interface board through a ribbon cable having a receptacle that is releasably engaged with a header on the interface board.

This attempt to solve the problem of connecting the main circuit board assembly to the backplane assembly is subject to the disadvantage that the conductor traces of the interface board are quite long, resulting in a high potential for crosstalk between the circuit traces. Further, the attachment pins are soldered to plated through-holes in both the connector board and the interface board and therefore the interface board cannot readily be detached from the connector board. Use of the attachment pins for both mechanical and electrical connection is unsatisfactory, since mechanical stresses may impair the electrical connection. The use of attachment pins does not lead to a rugged assembly, particularly since the pins lie in a single row and the major linear dimension of the interface board is perpendicular to that row. This design does not lend itself well to wider modules, having four rows of BNC connectors, since the traces in the connector board connecting the more distant rows to the attachment pins would have to be rather long.

SUMMARY OF THE INVENTION

In accordance with a first aspect of the present invention, electronic apparatus comprises a a transition board having first and second main faces and including conductive elements, elongate connecting means disposed on the first face of said transition board for releasably engaging a multi-row, multi-conductor edge connector, said connecting means including conductive elements and being of a first width, a single row, multi-conductor connector disposed on the second face of the transition board and including conductive elements that are electrically connected to conductive elements of said connecting means by conductive elements of the transition board, a connector board having first and second main faces and including conductive elements, mechanical attachment means effective between the connector board and the transition board, whereby the transition board is held with its second main face in spaced substantially parallel confronting relationship with the first main face of the connector board, receiving means disposed on the first main face of the connector board and including conductive elements that are electrically connected to conductive elements of the connector board, said receiving means releasably engaging the single-row, multi-conductor connector and occupying a predetermined region of the first main face of the connector board, said predetermined region being of a second width relative to the length of said connecting means, and a plurality of connectors on the second main face of the connector board including conductive elements that are electrically connected to conductive elements of said receiving means by way of conductive elements of the connector board, said plurality of connectors being disposed in at least first and second rows that are spaced from one another across a strip-form region of said second main face of the connector board, said strip-form region being of a third width that is less than said first width but greater than said second width, and said predetermined region, when projected to the second face of the connector board, lying wholly within said strip-form region.

In accordance with a second aspect of the invention, electronic a main circuit board having an edge, a transition board having first and second main faces and including circuit traces, a first connector composed of first and second engageable parts, the first part of the first connector being attached to the main circuit board at said edge thereof and the second part of the first connector being attached to the transition board at the first main face thereof, whereby when the first and second parts are engaged the transition board is substantially perpendicular to the main circuit board, the second part of the first connector comprising a plurality of conductive elements connected to said circuit traces of the transition board, a connector board having first and second main faces, the connector board being circuit board including conductive circuit traces, a plurality of coaxial connectors each having a cylindrical ground conductor surrounding a smaller diameter signal conductor, said coaxial connectors being mounted on the connector board at the second main face thereof with the signal conductors connected to said circuit traces of the connector board and the cylindrical ground conductors connected to the ground plane of the connector board, mechanical attachment means effective between the connector board and the transition board, whereby the transition board is held with its second main face in spaced substantially parallel confronting relationship with the first main face of the connector board, and a second connector composed of first and second parts in releasable mating engagement, the first part of the second connector being attached to the connector board at its first main face and comprising signal conductor elements connected to said traces of the connector board, and the second part of the second connector being attached to the transition board at its second main face and comprising conductor elements connected to said traces of the transition board and in electrically conductive contact with the conductor elements of the first part of the second connector, whereby conductors of the coaxial connectors are electrically connected to said conductive elements of the second part of said first connector.

In accordance with a third aspect of the invention, electronic apparatus comprises a main circuit board having an edge, a transition board having first and second main faces and including circuit traces, a first connector composed of first and second engageable parts, the first part of the first connector being attached to the main circuit board at said edge thereof and the second part of the first connector being attached to the transition board at the first main face thereof, whereby when the first and second parts are engaged the transition board is substantially perpendicular to the main circuit board, the second part of the first connector comprising a housing of insulating material formed with first, second and third rows of holes, the third row being between the first and second rows, and a plurality of conductive elements mounted in the first and second rows of holes respectively and connected to traces of the transition board, a connector board having first and second main faces and including circuit traces, mechanical attachment means effective between the connector board and the transition board, whereby the transition board is held with its second main face in spaced substantially parallel confronting relationship with the first main face of the connector board, and a second connector connecting circuit traces of the connector board to circuit traces of the transition board, said second connector comprising first and second parts in releasable mating engagement, the first part of the second connector being attached to the connector board at the first main face thereof and the second part of the second connector being attached to the transition board at the second main face thereof, the second part of the second connector including pines that extend through the transition board and project into the third row of holes of said housing.

In accordance with a fourth aspect of the invention, a backplane assembly for electronic apparatus comprises a transition board having first and second main faces and including conductive circuit traces, a connector part attached to the transition board at the first main face thereof and including conductive elements connected to said circuit traces of the transition board, a connector board having first and second main faces and including a conductive ground plane and conductive circuit traces, mechanical attachment means effective between the connector board and the transition board, whereby the transition board is held with its second main face in spaced substantially parallel confronting relationship with the first main face of the connector board, a plurality of coaxial connectors each having a cylindrical ground conductor surrounding a smaller diameter signal conductor, said coaxial connectors being mounted on the connector board at the second main face thereof with the signal conductors connected to said traces of the connector board and the cylindrical ground conductors connected to the ground plane of the connector board, and connector means composed of first and second parts in releasable mating engagement, the first part of said connector means being attached to the connector board at its first main face and being composed of signal conductor elements connected to said circuit traces of the connector board, and the second part of said connector means being attached to the transition board at its second main face and being composed of conductive elements that are connected to said traces of the transition board and are in electrically conductive contact with the conductor elements of the first part of said connector means, whereby conductors of the coaxial connectors are electrically connected to respective conductive elements of said connector part.

BRIEF DESCRIPTION OF THE DRAWINGS

For a better understanding of the invention, and to show how the same may be carried into effect, reference will now be made, by way of example, to the accompanying drawings in which.

Like reference numerals in the figures designate corresponding elements.

DETAILED DESCRIPTION

Figure 1:
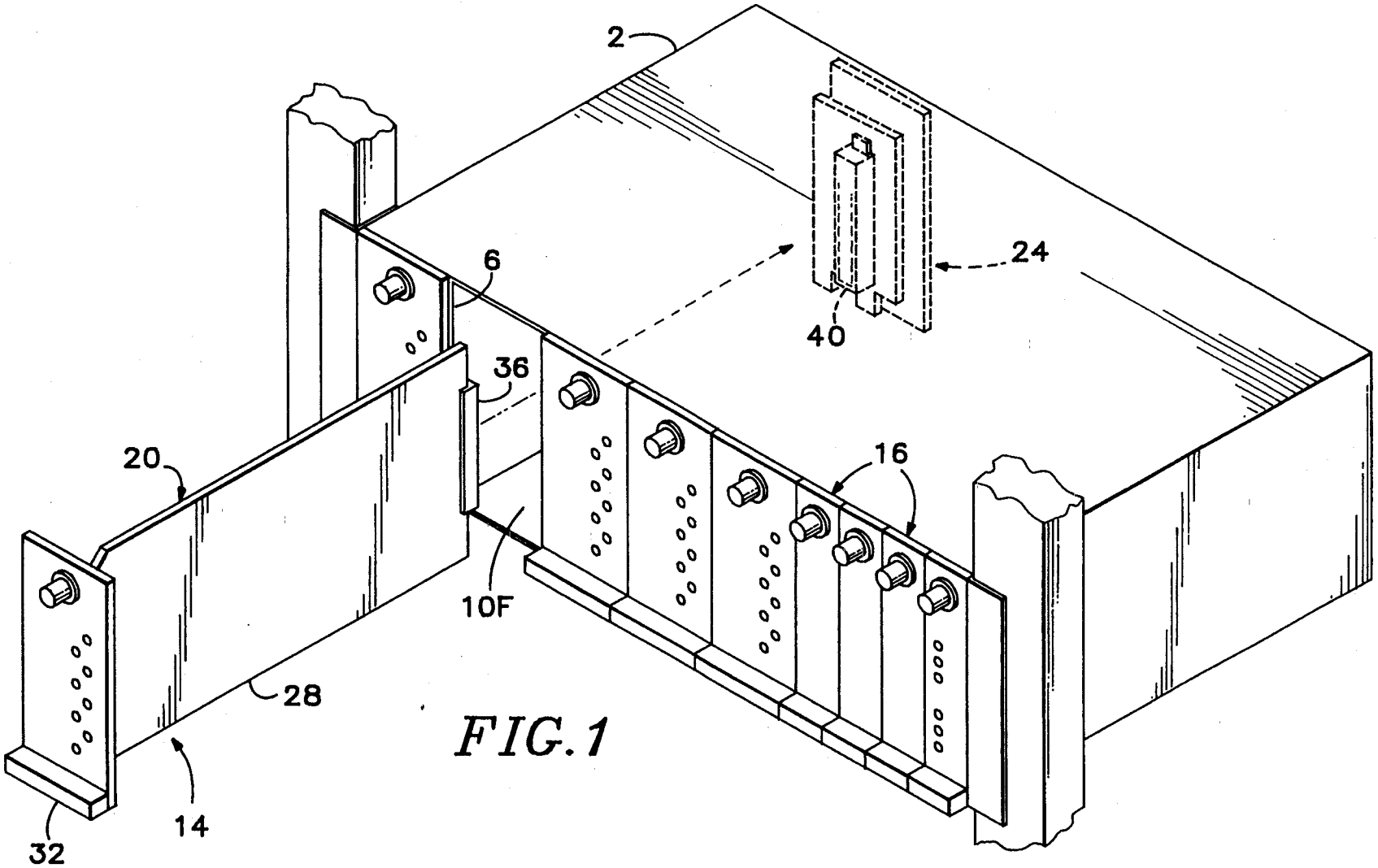
FIG. 1 is a perspective view of modular electronic products installed in a standard frame.
Figure 2:
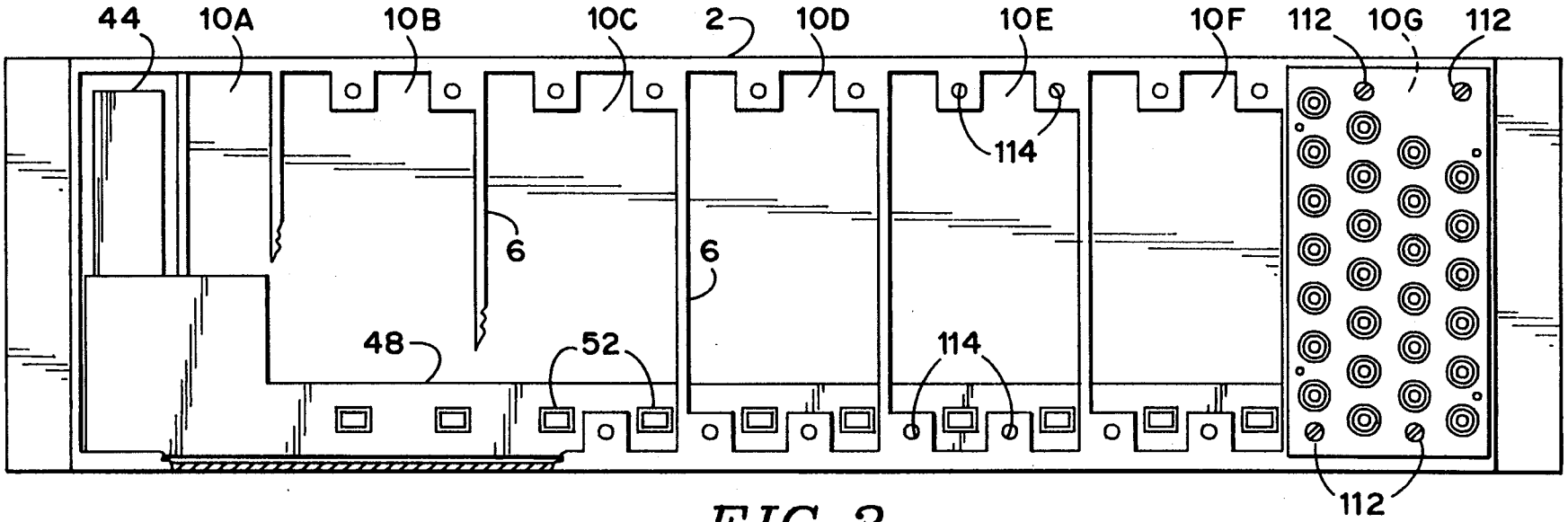
FIG. 2 is a rear elevation of the frame, and shows a power supply.

FIGS. 1 and 2 show a casing or frame 2 divided by internal walls 6 into seven equal-sized compartments 10A–10G. Each compartment can receive either one double-wide module 14 or two single-wide modules 16. A typical double-wide module 14 is shown in simplified form in FIG. 1 and comprises a main circuit board assembly 20 and a backplane assembly 24. The main circuit board assembly comprises a main circuit board 28 that extends over substantially the entire depth of the frame, and a front panel 32 attached to the main circuit board. The main circuit board is provided along its edge that is farther from the front panel with the female portion, or receptacle, 36 of a DIN connector. The backplane assembly includes the male portion, or header, 40 of the DIN connector.

Referring to FIG. 2, a power supply 44 is installed in the compartment 10A that is at the left of the frame when viewed from the rear, and a power supply circuit board 48 extends from the power supply compartment across the other compartments 10B–10G. The power supply circuit board includes conductor traces that are connected to the power supply. Twelve eight-pin power supply connectors have their respective receptacles 52 mounted on power supply circuit board 48, one receptacle 52 being on the left and one on the right of each of compartments 10B–10G. Two pins of each receptacle are for a +12.75 volt supply, two for a −12.75 volt supply and the remaining four pins are for ground.

Backplane assembly 24 is shown in greater detail in FIGS. 3–6. Backplane assembly 24 comprises a connector circuit board 60 that includes many conductor traces that terminate at plated through-holes in board 60. Representative circuit traces 62 are shown schematically in FIG. 4. Connector board 60 also includes a ground plane 63, which is shown schematically. Connector board 60 carries four rows of BNC connectors 64. Each two adjacent rows are staggered in order to provide a distance between the centers of nearest-neighbors of at least 1.6 cm while keeping the horizontal distance between the centers of adjacent rows of BNC connectors to less than 1.5 cm. The horizontal width W of the strip-form region 65 between the areas occupied by two adjacent rows is less than about 0.5 cm.

Each BNC connector 64 is a coaxial connector comprising an outer shell 66 and an inner receptacle 68. Four tabs 70 on the shell of each BNC connector extend through respective plated through-holes in connector board 60, and a pin 72 that is electrically connected to inner receptacle 68 similarly extends through a plated through-hole in board 60. After loading the connector board with the BNC connectors, the connector board is passed through a wave solder machine, in which tabs 70 and pins 72 are soldered to metal pads that surround the respective through-holes. In this manner, the BNC connectors are securely attached to connector board 60 and reliable electrical connections are established between the BNC connectors and conductive portions (circuit traces and ground plane) of the connector board.

Referring again to FIG. 3, backplane assembly 24 also comprises a transition board 80, which is attached to connector board 60 in spaced, parallel, mutually confronting relationship by standoffs 82 and screws 84. Transition board 80 includes many conductor traces that terminate at plated through-holes in board 80. Representative traces 86 are shown schematically in FIG. 5. Transition board 80 also includes a ground plane (not shown).

The female portions 88 of two SIP connectors are mounted on transition board 80. Each portion 88 has 32 conductive pins 90, which are received in respective plated through-holes of the transition board. By wave soldering, the pins 90 are securely attached to transition board 80 and reliable electrical connection is established between the pins 90 and conductor traces of the transition board. It will be noted that pins 90 project from transition board 80, and that solder tails 92 are deposited on the projecting pins and the surrounding metal pads (not shown) during the wave solder operation.

Conductor traces of the transition board extend from the plated through-holes in which pins 90 are received to plated through-holes 94 that are intermediate the two rows of through-holes that received pins 90. Plated through-holes 94 are in three rows 95A, 95B and 95C of 32 holes each. Pins 90 are connected to holes 94 in rows 95A and 95C on a straight across, one-to-one basis.

Figure 3:
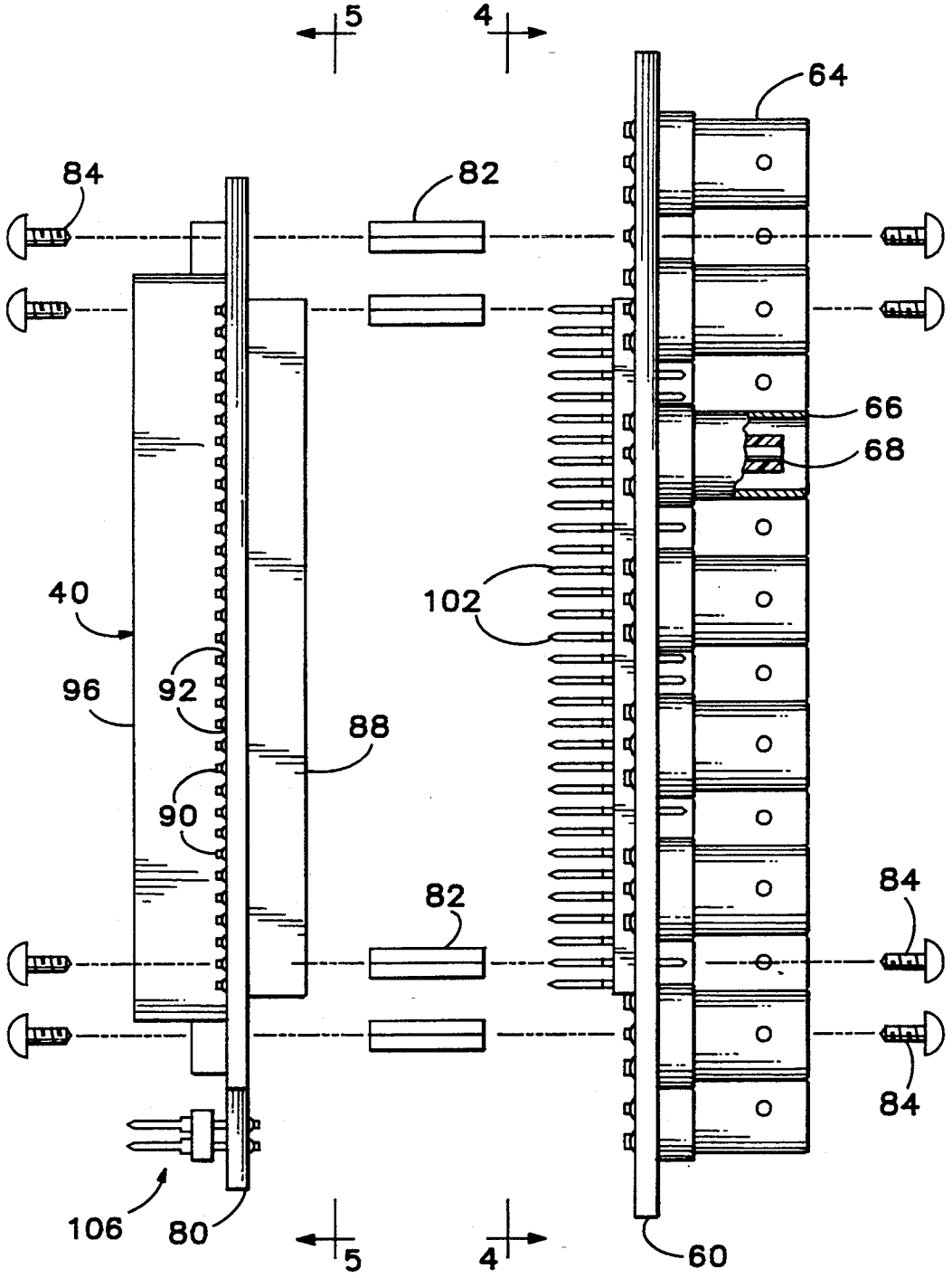
FIG. 3 is an exploded view of the backplane assembly for one of the double-wide modules shown in FIG. 1.
Figure 6:
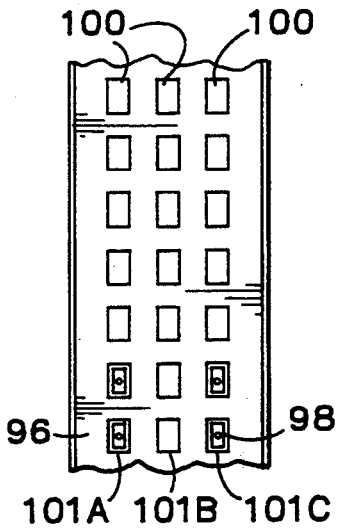
FIG. 6 is a detail on an enlarged scale of a component of the backplane assembly shown in FIG. 3.

Referring to FIGS. 3 and 6, connector portion 40 comprises a housing 96 of insulating material formed with holes 100 in three rows 101A, 101B and 101C, and conductive pins 98 fitted in holes 100 and projecting from housing 96. Representative pins 98 are shown in FIG. 6. Connector portion 40 is a compliant pin device, and insertion of pins 98 in holes 94 results in connector portion 40 being firmly attached to transition board 80.

The male portions 102 of the two SIP connectors are compliant pin devices, and these are installed in two rows of plated through-holes in connector board 60. These plated through-holes are connected through circuit traces of connector board 69 to various pins of BNC connectors 64.

The headers 106 of two of the twelve power supply connectors are also mounted on transition board 80. Headers 106 are compliant pin devices and the eight pins of each header are fitted in respective plated through holes of transition board 80. Conductor traces of transition board 80 connect the pins of power supply headers 106 to plated through-holes 94 in row 95B and thus to pins 98 in the central row 101B of DIN connector portion 40.

Connector board 60 is formed with holes 110 for receiving screws 112 (FIG. 2) for attaching backplane assembly 24 to frame 2. The location of holes 110 relative to power supply headers 106 is such that screws 112 can be fitted through holes 110 into internally threaded holes 114 (FIG. 2) in frame 2 when headers 106 are engaged with two of the receptacles 52 mounted on power supply circuit board 48.

When backplane assembly 24 is attached to frame 2 at the rear of compartment 10F, for example, and the main circuit board assembly is inserted into compartment 10F, the connector portion 36 of the main circuit board engages the connector portion 40 of backplane assembly 24 and reliable electrical connection is established between the main circuit board and appropriate points of the backplane assembly.

Since the SIP connectors are between the rows of BNC connectors, the circuit traces of the connector board are very short. Similarly, since the DIN connector is between the two SIP connectors, the traces of the transition board are very short. The attachment of the transition board to the connector board results in a very rugged backplane assembly. Nevertheless, the transition board is readily detachable from the connector board if this should be necessary.

Figure 7:
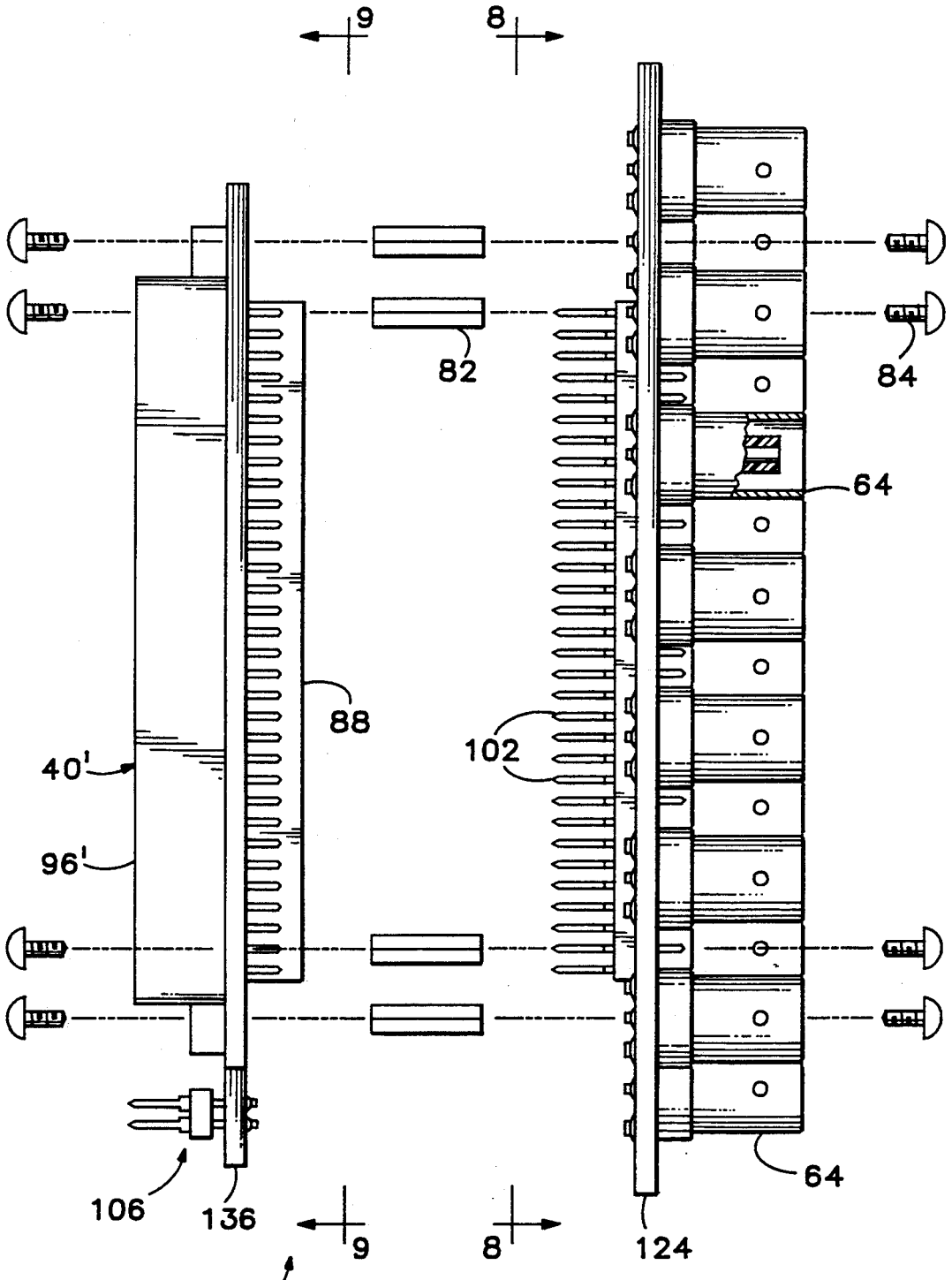
FIG. 7 is an exploded view of the backplane assembly for one of the single-wide modules shown in FIG. 1.
Figure 8:
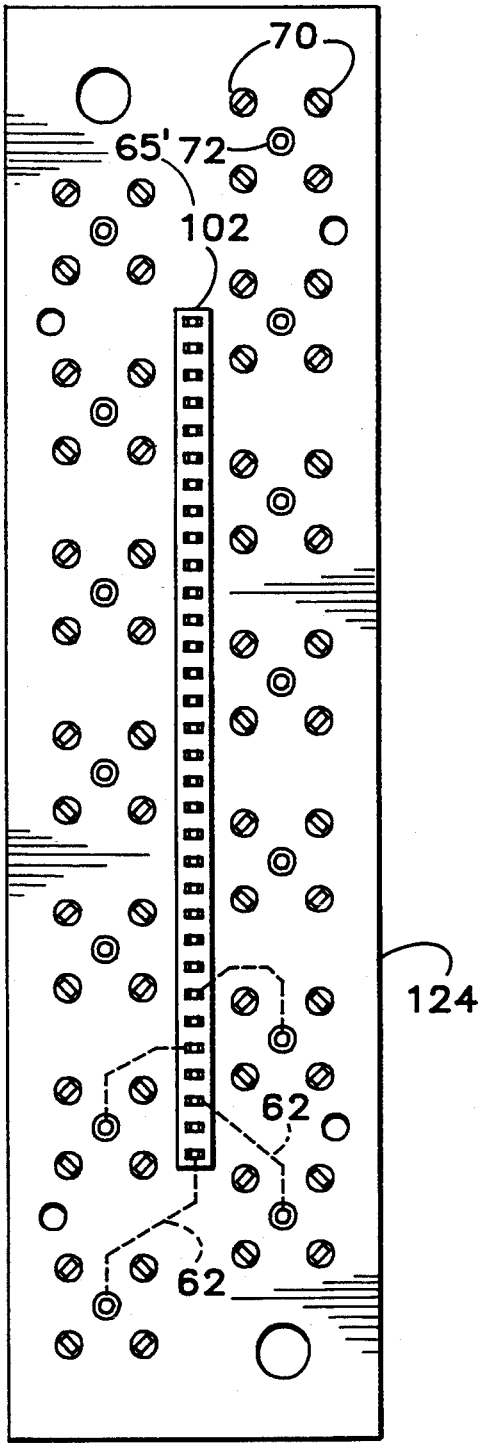
FIG. 8 is a sectional view taken on the line 8—8 of FIG. 7.
Figure 9:
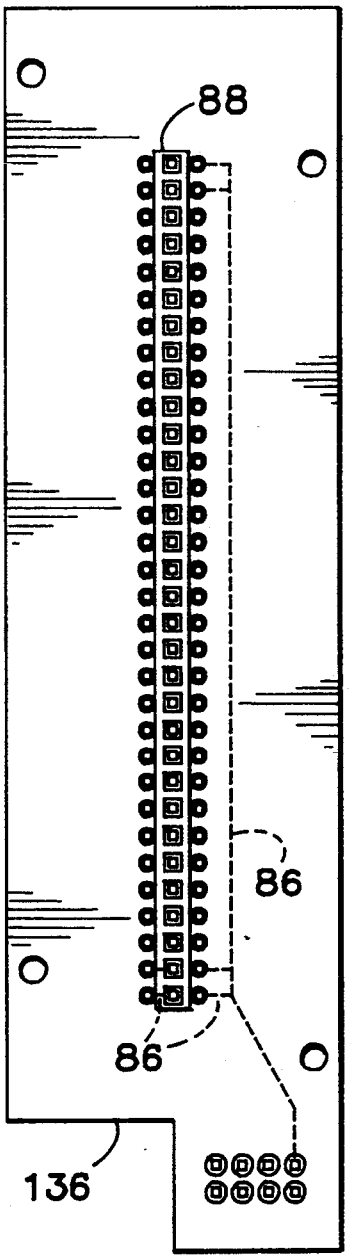
FIG. 9 is a sectional view taken on the line 9—9 of FIG. 7.

FIGS. 7–9 show the backplane assembly 120 for a single-wide module. This backplane assembly comprises a connector board 124 having fourteen BNC connectors 64 mounted thereon in two rows of seven connectors separated by a strip-form region 65' of width W'.

The compliant pin male portion or header 102 of a SIP connector is mounted on the connector board between the two rows of BNC connectors. Connector board 124 has 32 plated through-holes in a single row between the two rows of BNC connectors, and the pins of connector portion 102 are fitted in these holes respectively. In this manner, connector portion 102 is securely attached to connector board 124.

Figure 4:
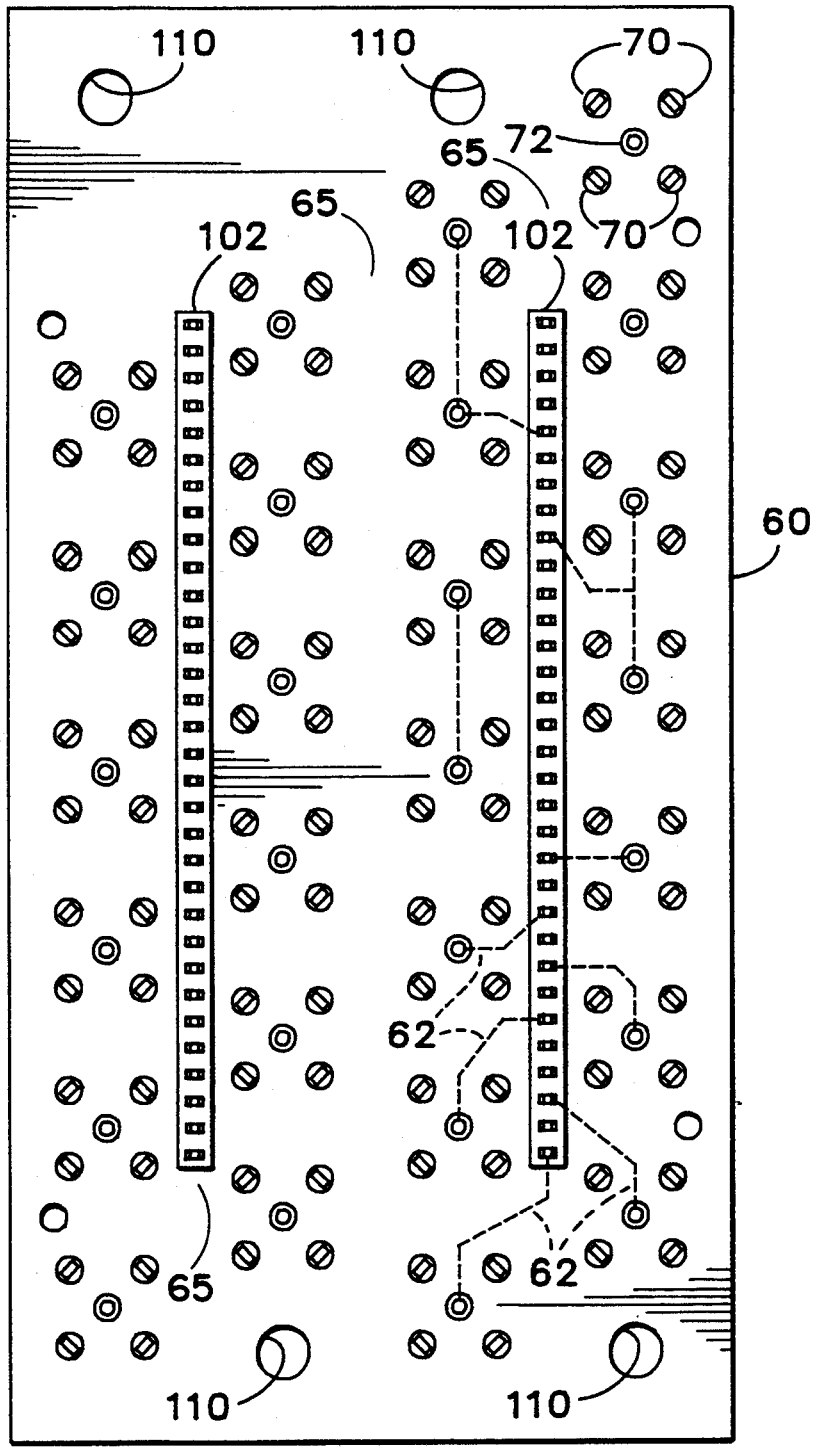
FIG. 4 is a sectional view taken on the line 4—4 of FIG. 3.
Figure 5:
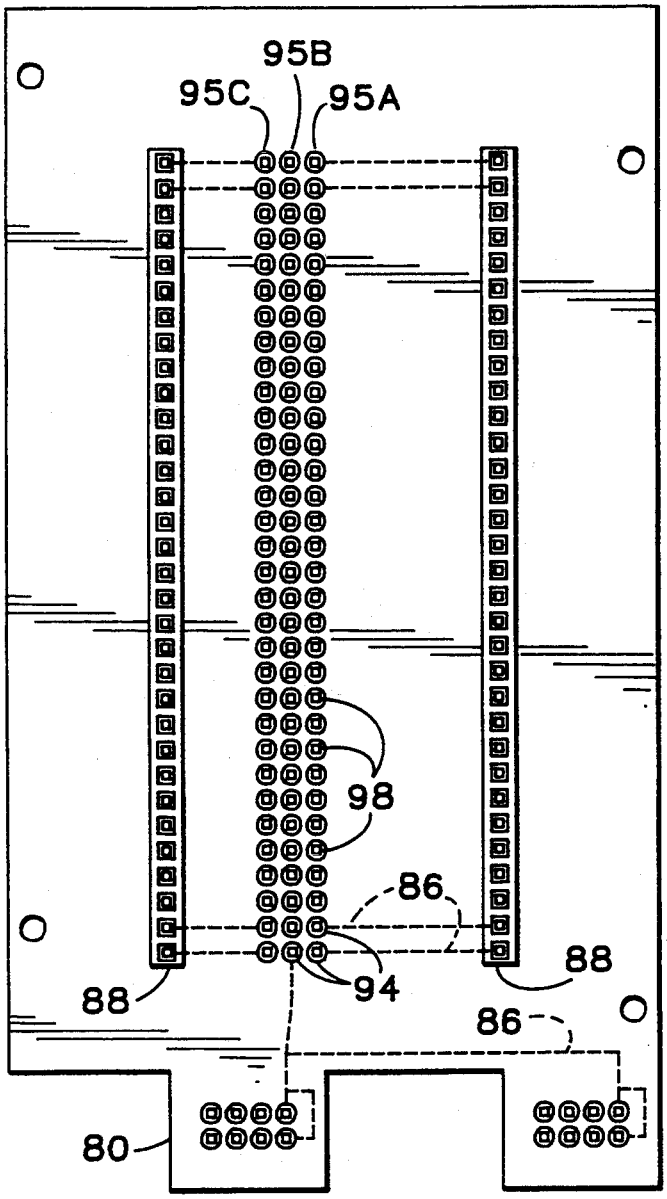
FIG. 5 is a sectional view taken on the line 5—5 of FIG. 3.

The female portion 88 of the SIP connector is attached to a transition board 136 in the manner described with reference to FIGS. 3–5.

The male portion or header 40' of a DIN connector is mounted on transition board 136. Header 40' has only two rows of pins, the center row of holes in housing 96' being vacant. Header 40' is positioned on transition board 136 so that the solder tails of SIP receptacle 88 are accommodated in the central row of holes of housing 96'. Thus, header 40' is secured flat against transition board 136 but nevertheless overlies receptacle 88. The traces of transition board 136 connect the pins of receptacle 88 to respective pins in one of the two rows of pins in header 40'.

Transition board 136 carries the header 106 of a power supply connector. Backplane assembly 120 can be attached to frame 2 at the rear of compartment 10B, for example, either on the right or the left of that compartment. If, for example, backplane assembly is placed at the left of compartment 10B, header 106 engages the left receptacle 52 associated with compartment 10B. Traces of transition board 136 connect the pins of header 106 to pins of header 40' in the row whose pins are not connected to pins of receptacle 88.

The circuit traces of connector board 124 and transition board 136 are very short, and therefore crosstalk between traces is minimized.

It will be appreciated that the invention is not restricted to the particular embodiments that have been described, and that variations may be made therein without departing form the scope of the invention as defined in the appended claims and equivalents thereof.

We claim:

1. Electronic backplane apparatus comprising:

a transition board having first and second main faces and including conductive elements, elongate connecting means disposed on the first face of said transition board for releasably engaging a multi-row, multi-conductor edge connector, said connecting means including conductive elements and being of a first width, a single-row, multi-conductor connector disposed on the second face of the transition board and including conductive elements that are electrically connected to conductive elements of said connecting means by conductive elements of the transition board, a connector board having first and second main faces and including conductive elements, mechanical attachment means effective between the connector board and the transition board, whereby the transition board is held with its second main face in spaced substantially parallel confronting relationship with the first main face of the connector board, receiving means disposed on the first main face of the connector board and including conductive elements that are electrically connected to conductive elements of the connector board, said receiving means releasably engaging the single-row, multi-conductor connector and occupying a predetermined region of the first main face of the connector board, said predetermined region being of a second width relative to the length of said connecting means, and a plurality of connectors on the second main face of the connector board including conductive elements that are electrically connected to conductive elements of said receiving means by way of conductive elements of the connector board, said plurality of connectors being disposed in at least first and second rows that are spaced from one another across a strip-form region of said second main face of the connector board, said strip-form region being of a third width that is less than said first width but greater than said second width, and said predetermined region, when projected to the second face of the connector board, lying wholly within said strip-form region.

2. Electronic backplane apparatus according to claim 1, wherein the single-row, multi-conductor connector is disposed on the transition board immediately opposite said connecting means such that said second width as projected to the first face of the transition board is within said first width.

3. Electronic backplane apparatus according to claim 2, wherein said elongate connecting means comprises a housing of insulating material formed with first, second and third rows of holes, the third row being between the first and second rows, the conductive elements of said connecting means are mounted in the first and second rows of holes, and the conductive elements of the single-row, multi-conductor connector extend through the transition board and project into the third row of holes of said housing.

4. Electronic backplane apparatus according to claim 3, wherein the conductive elements mounted in said first and second rows of holes pass through the transition board and project from the second main face thereof, and the single-row, multi-conductor connector includes a housing of insulating material positioned between the projecting portions of the two rows of conductive elements.

5. Electronic backplane apparatus according to claim 1, further comprising:

a second single-row, multi-conductor connector disposed on the second face of the transition board and including conductive elements that are electrically connected to conductive elements of said connecting means by conductive elements of the transition board, second receiving means including conductive elements that are connected to conductive elements of the connector board, said second receiving means releasably engaging the second single-row, multi-conductor connector and occupying a second predetermined region of the first main face of the connector board, said second predetermined region being of said second width relative to the length of the connecting means, and wherein said plurality of connectors includes connectors that are disposed in third and fourth rows that are spaced from one another across a second strip-form region of said second main face of the connector board, said second strip-form region being of a width that is less than said first width but greater than said second width, and said second predetermined region, when projected to the second face of the connector board, lying wholly within said second strip-form region.

6. Electronic backplane apparatus according to claim 1, further comprising supplemental connector means disposed on the transition board and including conductive elements that are electrically connected to conductive elements of said connecting means by way of conductive elements of the transition board.

7. Electronic backplane apparatus according to claim 1, wherein the connectors of said plurality of connectors are coaxial connectors.

8. Electronic apparatus comprising:

a main circuit board having an edge, a transition board having first and second main faces and including circuit traces, a first connector composed of first and second engageable parts, the first part of the first connector being attached to the main circuit board at said edge thereof and the second part of the first connector being attached to the transition board at the first main face thereof, whereby when the first and second parts are engaged the transition board is substantially perpendicular to the main circuit board, the second part of the first connector comprising a housing of insulating material formed with first, second and third rows of holes, the third row being between the first and second rows, and a plurality of conductive elements mounted in the first and second rows of holes respectively and connected to traces of the transition board, a connector board having first and second main faces and including circuit traces, mechanical attachment means effective between the connector board and the transition board, whereby the transition board is held with its second main face in spaced substantially parallel confronting relationship with the first main face of the connector board, and a second connector connecting circuit traces of the connector board to circuit traces of the transition board, said second connector comprising first and second parts in releasable mating engagement, the first part of the second connector being attached to the connector board at the first main face thereof and the second part of the second connector being attached to the transition board at the second main face thereof, the second part of the second connector including pins that extend through the transition board and project into the third row of holes of said housing.

9. Apparatus according to claim 8, comprising a plurality of signal connectors mounted on the connector board at the second main face thereof and connected to traces of the connector board, whereby the second connector connects the signal connectors to the conductive elements of the second part of said first connector.

10. Apparatus according to claim 8, comprising a plurality of coaxial connectors each having a cylindrical ground conductor surrounding a smaller diameter signal conductor, said coaxial connectors being mounted on the connector board at the second main face thereof with the signal conductors connected to said circuit traces of the connector board and the cylindrical ground conductors connected to the ground plane of the connector board, and wherein the coaxial connectors are mounted on the connector board in at least first and second rows, and the first part of the second connector is placed between said first and second rows.

11. Apparatus according to claim 8, wherein the second part of the first connector has two rows of conductive elements that pass through the transition board and project from the second main face thereof, and the second part of the second connector is positioned between the two rows of conductive elements.

12. Apparatus according to claim 8, comprising a power supply connector part mounted on the transition board and including conductive elements that are connected by circuit traces of the transition board to conductive elements of the second part of the first-mentioned connector.

13. Electronic apparatus according to claim 8, wherein the connector board comprises a ground plane and the apparatus further comprises a plurality of coaxial connectors each having a cylindrical ground conductor surrounding a smaller diameter signal conductor, said coaxial connectors being mounted on the connector board at the second main face thereof with the signal conductors connected to said circuit traces of the connector board and the cylindrical ground conductors connected to the ground plane of the connector board, and wherein the first part of the second connector comprises signal conductor elements connected to said traces of the connector board, and the pins of the second part of the second connector are connected to said circuit traces of the transition board and are in electrically conductive contact with the conductor elements of the first part of the second connector, whereby conductors of the coaxial connectors are electrically connected to conductive elements of the second part of said first connector.

14. A backplane assembly for electronic apparatus, said backplane assembly comprising:

a transition board having first and second main faces and including conductive circuit traces, a connector part attached to the transition board at the first main face thereof and including conductive elements connected to said circuit traces of the transition board, a connector board having first and second main faces and including a conductive ground plane and conductive circuit traces, mechanical attachment means effective between the connector board and the transition board, whereby the transition board is held with its second main face in spaced substantially parallel confronting relationship with the first main face of the connector board, a plurality of coaxial connectors each having a cylindrical ground conductor surrounding a smaller diameter signal conductor, said coaxial connectors being mounted on the connector board at the second main face thereof with the signal conductors connected to said traces of the connector board and the cylindrical ground conductors connected to the ground plane of the connector board, and connector means composed of first and second parts in releasable mating engagement, the first part of said connector means being attached to the connector board at its first main face and being composed of signal conductor elements connected to said circuit traces of the connector board, and the second part of said connector means being attached to the transition board at its second main face and being composed of conductive elements that are connected to said traces of the transition board and are in electrically conductive contact with the conductor elements of the first part of said connector means, whereby conductors of the coaxial connectors are electrically connected to respective conductive elements of said connector part.

15. A backplane assembly according to claim 14, wherein the transition board includes additional conductive circuit traces and said connector part comprises additional conductive elements connected to said additional circuit traces, and the backplane assembly further comprises a power supply connector part including conductive elements connected to said additional conductive elements of said connector part of said additional conductive circuit traces of the transition board.

16. A backplane assembly according to claim 14, wherein the connector part that is attached to the transition board at the first main face thereof comprises a housing of insulating material, said housing being formed with first, second and third rows of holes, the third row being between the first and second rows, said conductive elements are mounted in the first and second rows of holes respectively, and said second signal connector part includes pins that extend through the transition board and project into the third row of holes of said housing.

17. A backplane assembly according to claim 16, wherein the conductive elements mounted in the first and second rows of holes of the connector part that is attached to the transition board at the first main face thereof pass through the transition board and project from the second main face thereof, and the second part of said connector means comprises a housing of insulating material positioned between the projecting portions of the two rows of conductive elements.

* * * * *